United States Patent [19]

Lottick

[11] 4,441,640

[45] Apr. 10, 1984

[54] NON-SPILLABLE DRINKING CONTAINER

[76] Inventor: Edward A. Lottick, 41 Gershom Pl., Kingston, Pa. 18704

[21] Appl. No.: 480,565

[22] Filed: Mar. 30, 1983

[51] Int. Cl.[3] ..... A45F 5/02; B65D 83/00; B65D 23/00; B65D 51/24

[52] U.S. Cl. ..... 224/252; 62/457; 215/1 A; 220/90.2; 220/90.4; 224/249; 229/7 S

[58] Field of Search ..... 220/375, 90.2, 90.4; 229/7 S; 215/1 A, 11; 224/249, 268, 252, 269; 62/457, 371, 372, 529, 530; 222/566-572

[56] References Cited

U.S. PATENT DOCUMENTS

| | | | |
|---|---|---|---|
| 942,306 | 12/1909 | Clarke | 215/1 A |
| 1,465,497 | 8/1923 | Tandy | 62/457 X |
| 1,813,285 | 7/1931 | Galetschky . | |
| 2,741,402 | 4/1956 | Sayre | 220/67 X |
| 2,800,265 | 7/1957 | Pugh, Sr. . | |
| 2,815,981 | 12/1957 | Nonnamaker et al. . | |
| 2,914,214 | 11/1959 | Messinger . | |
| 2,948,453 | 8/1960 | Drown . | |
| 3,106,312 | 10/1963 | Hitchcock . | |
| 3,172,561 | 3/1965 | Schwartz | 220/90.2 |
| 3,206,054 | 9/1965 | Militello . | |
| 3,240,415 | 3/1966 | Pugh, Sr. . | |
| 3,291,331 | 12/1966 | Grishham | 215/1 A |
| 3,438,527 | 4/1969 | Gamblin, Jr. . | |
| 3,558,033 | 1/1971 | Leeds . | |
| 3,785,794 | 1/1974 | Hodges . | |
| 3,840,153 | 10/1974 | Devlin . | |
| 4,109,817 | 8/1978 | Payne et al. . | |
| 4,228,913 | 10/1980 | Mack et al. . | |
| 4,239,132 | 12/1980 | Mueller et al. . | |
| 4,291,814 | 9/1981 | Conn . | |
| 4,338,795 | 7/1982 | House, Jr. | 62/457 X |

FOREIGN PATENT DOCUMENTS

| | | | |
|---|---|---|---|
| 1068240 | 12/1979 | Canada | 224/252 |
| 11472 | 11/1880 | Fed. Rep. of Germany | 220/90.2 |
| 154212 | of 0000 | Fed. Rep. of Germany | 215/1 A |

*Primary Examiner*—Allan N. Shoap
*Assistant Examiner*—Robert Petrik
*Attorney, Agent, or Firm*—Michael F. Petock

[57] ABSTRACT

A non-spillable drinking container is comprised of a resiliently flexible material with a drinking tube or straw sealably mounted therethrough. The drinking tube or straw is moveable toward and away from the bottom of the container. The lower end of the drinking tube is provided with an elastic diaphragm connected to the bottom of the container. Tension on the drinking tube away from the bottom of the container causes the lower end of the tube to be lifted away from the bottom and perforations in the diaphragm to be stretched open to allow fluid flow through the perforations in the diaphragm and out through the drinking tube. In the absence of tension being applied to the drinking tube causing it to be pulled away from the bottom of the container, the holding of the container upside down or the application of pressure to the walls of the container will not cause liquid to leak from the non-spillable drinking container.

33 Claims, 10 Drawing Figures

NON-SPILLABLE DRINKING CONTAINER

BACKGROUND OF THE INVENTION

The present invention is directed to a non-spillable drinking container.

In the past there had been a need for an effective non-spillable drinking container. There are many applications where such a drinking container would be extremely desirable. Applications include anywhere where there is a need to prevent spills of fluids being drunk, such as soda, and there is some increased reason for the likelihood of spillage. For example, soda pop dispensed in movie theaters in drinking cups often results in the spillage by children of some or all of the soda pop on the floor, carpeted aisles or even seats, especially during the drinking process. Even with respect to adults, very often the adult will discard the cup of soda on the floor before the cup is completely empty. Unfortunately, the cup is often kicked or bumped over by a patron or otherwise upset before it is removed by the cleaning personnel at the end of the day. This results in a sticky mess on the floor of the theater which involves additional cost in cleaning.

Additionally, such a non-spillable drinking container is highly desirable in other applications where there is an increased probability of spillage during drinking, such as in hospitals and nursing homes with debilitated patients and in moving vehicles, such as airplanes, boats, ships, trains and automobiles.

A non-spillable liquid drinking container is shown in U.S. Pat. No. 2,948,453 - Drown. Drown discloses a capable cup in which a perforated straw is spring mounted within a cylindrical tube within the cup. Downward pressure on the straw forces a portion of the straw out of the cylindrical tube to enable flow of liquid through the straw.

It has also been known to utilize a flexible wall container for the dispensing of fluids, such as taught by U.S. Pat. No. 3,840,153 - Devlin. Devlin discloses a drinking utensil having means for insertion of a permanently hermetically sealed refrigerant capsule and a valve operable by positioning a dispensing tube.

None of the prior art discloses a non-spillable drinking container which does not allow spillage even should it be dropped to the floor in a turned down manner. The non-spillable liquid drinking container disclosed in the Drown patent has a removable top and furthermore, if it hit the floor in an upside down manner, the drinking straw would be forced against the spring allowing flow out through the straw. The device of Devlin does not provide a non-spillable feature unless the outflow valve is manually closed. In accordance with the present invention, there is no need to exercise any manual control and the non-spillable drinking container of the present invention automatically provides a non-spill function.

SUMMARY OF THE INVENTION

In accordance with the present invention, a non-spillable drinking container is provided which includes the advantage that the container is always in the condition where spills may be avoided, even where a reasonable amount of pressure is applied to the container.

The present invention provides a further advantage of a drinking container which may be provided with a reusable refrigerant means and may be adapted to various applications.

Briefly and basically, in accordance with the present invention, there is provided a non-spillable liquid drinking container. The container is provided with a substantially flat surface and at least one opening therethrough substantially opposite the flat surface. A tube is mounted at least partially within the container. In one embodiment it may extend through the opening in the container for a predetermined distance. Sealing means is provided for forming a seal between the outer surface of the tube and the opening through the container. The sealing means allows movement of the tube in a direction toward or away from the substantially flat surface of the container. An expandable diaphragm is mounted to the tube in proximity to the end of the tube juxtaposed the substantially flat surface of the container. The periphery of the diaphragm is mounted to the container, and the diaphragm is provided with perforations therethrough which are normally closed in the unexpanded state of the diaphragm and which are opened when the diaphragm is stretched by movement of the tube away from the substantially flat surface of the container.

In a preferred embodiment of the present invention, there is provided a non-spillable liquid drinking container. The container is provided with a bottom, sidewall and top portion. The top portion is provided with at least one opening therethrough. A tube is mounted partially within the container and extends through the opening in the top of the container for a predetermined distance. Sealing means is provided for forming a seal between the outer surface of the tube and the opening through the top and allowing movement of the tube in a direction toward or away from the bottom of the container. A flexible diaphragm is mounted to the tube in proximity to the end of the tube juxtaposed the bottom of the container. The diaphragm is provided with perforations therethrough which are normally closed in the unexpanded state of the diaphragm and which are open when the diaphragm is stretched by movement of the tube away from the bottom of the container.

BRIEF DESCRIPTION OF THE DRAWINGS

For the purpose of illustrating the invention, there is shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
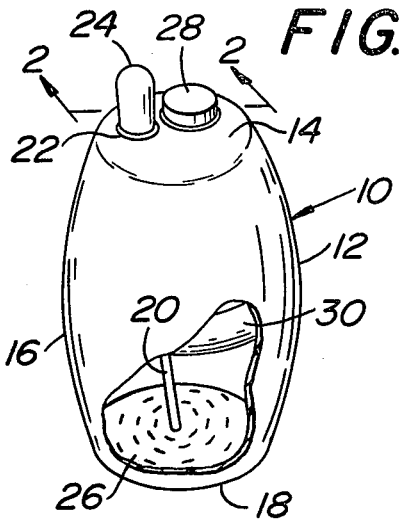
FIG. 1 is a view in perspective, partially broke away, of a non-spillable liquid drinking container in accordance with the present invention.
Figure 2:
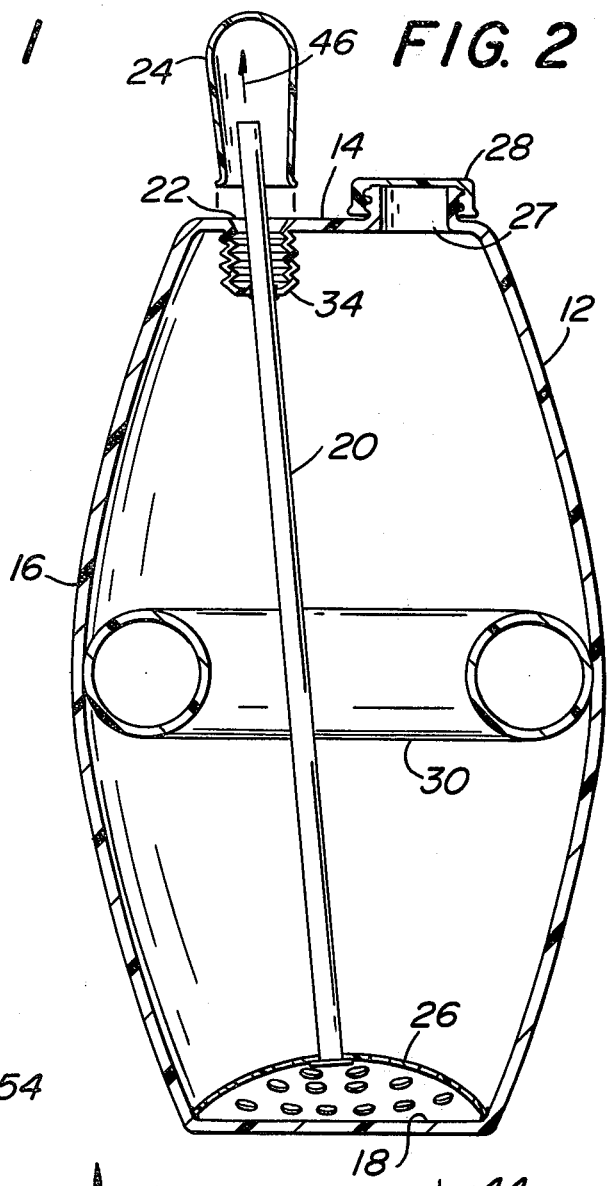
FIG. 2 is a cross-sectional view taken along line 2—2 of FIG. 1.

Referring now to the drawings, wherein like numerals indicate like elements, there is shown in FIGS. 1 and 2 a non-spillable liquid drinking container 10. The present description may be best understood by simultaneous reference to FIGS. 1 and 2, FIG. 2 being a cross-sectional view taken along line 2—2 of FIG. 1. The container 12 may be comprised of a top portion 14, sidewall portion 16 and a bottom or substantially flat surface 18. In the preferred embodiment disclosed in FIGS. 1 and 2, the substantially flat surface 18 would comprise the bottom of the container. However, it is understood, that within the concept of the present invention, the substantially flat surface against which the inner end of tube 20 rests need not be located on the bottom of the container, but the sealing mechanism of the present invention could operate against any flat surface, including a substantially vertical sidewall. It is also understood that the top 14 could also be described as a portion of container 12 opposite the substantially flat surface 18.

A portion of the container 12 is provided with an opening for tube 20. Preferably, this opening 22 would be located in the top portion 14 of container 12. The tube 20 may be considered to be a drinking straw. Tube 20 is mounted through opening 22 in container 12 and is provided with a sealing means 34 for providing a seal between the outer surface of the tube and the opening 22 through container 12. Sealing means 34 is of the type which allows movement of the tube in a direction toward or away from the substantially flat surface or bottom 18 of container 12. In a preferred embodiment as shown in FIG. 2, this sealing means 34 may be comprised of a bellows type structure constructed of a suitably thin flexible synthetic plastic material. The entire structure of container 12 and sealing means 34 may be molded preferably from a suitable flexible synthetic plastic material as a single unit, but such material need not necessarily be flexible nor the molding unitary within the bounds and spirit of the present invention.

The tube 20 extends outside of container 12 through opening 22 for a predetermined distance. The portion of tube 20 extending out of container 12 is provided with a removable cover 24 for sanitary purposes. The cover 24 may be readily removed as shown in FIG. 2, or it may be made of a sufficiently thin and tearable material to enable rapid and easy tearing of cover 24 to enable drinking through tube 20 by a consumer.

Figure 5:
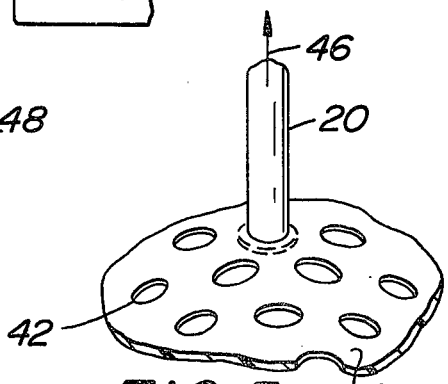
FIG. 5 is a broken away view in perspective of a portion of the expandable diaphragm attached to the tube in the expanded state.
Figure 6:
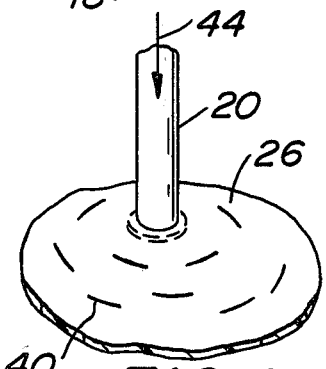
FIG. 6 is a broken away view in perspective of the expandable diaphragm attached to the tube in the unexpanded state.

The inner or lower end of tube 20 is connected to container 12 by means of an expandable diaphragm 26. In other words, the end of tube 20 juxtaposed to the substantially flat surface or bottom 18 of container 12 is mounted to expandable diaphragm 26. The outer periphery of expandable diaphragm 26 is mounted to the inner surface of container 12, preferably at the juncture of bottom 18 and sidewall 16, but other locations of mounting are readily apparent and are within the scope of the present invention. The diaphragm 26 is provided with perforations therethrough. The perforations in expandable diaphragm 26 may be slits 40 as shown in FIG. 6. Preferably, these slits, in the unexpanded condition of diaphragm 26 may be formed to have their longitudinal direction perpendicular to imaginary radial lines of diaphragm 26. Normally, when there is not an upward tension on tube 20 (in the direction of arrow 46) or when there is a force in the direction of arrow 44, diaphragm 26 is in its unexpanded condition, and the slits 40 are closed. When tube 20 is drawn in an upward direction, in the direction of arrow 46 shown in FIG. 5, such as by the lips of a consumer desiring to take a drink from the container, expandable diaphragm 26 is expanded and the slits 40 are caused to open as shown at 42 in FIG. 5. When there is not an upward tension on tube 20, there is tension on tube 20 drawing it toward substantially flat surface 18, the lower end or inner end of tube 20 is drawn against the bottom or substantially flat surface 18 and the perforations through the expandable diaphragm 26 are closed so that there can be no outflow of fluid from container 12 through tube 20 even if the container is held upside down or if there is pressure applied to the lateral walls 16 tending to compress container 12.

Figure 3:
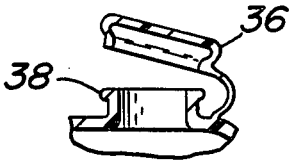
FIG. 3 is a broken away cross-sectional view illustrating an alternate sealing means.

Container 12 may preferably be provided with a second opening 27 provided with a cap 28. The cap may be a screw-type cap 28 as shown in FIG. 2. However, other suitable means of capping or sealing this second opening may be provided, such as the snap-type cap 36 shown in FIG. 3 which snaps over a rim 38. It is understood that other suitable sealing means for this second opening may be provided within the scope of the present invention. Opening 27 may be conveniently utilized for rapid filling of container 12 and possibly for the insertion of items such as ice cubes. However, preferably, a sealed refrigerant container 30 may be provided within container 12.

As shown in FIGS. 1 and 2, a sealed refrigerant container 30 may be provided in the shape of a circle of rotation, or otherwise described as a ring, which taken in cross section is in the form of a circle. The structure 30 may be a sealed structure filled with a refrigerant fluid. The refrigerant fluid may be frozen prior to the filling of container 12 or at other appropriate times.

Figure 4:
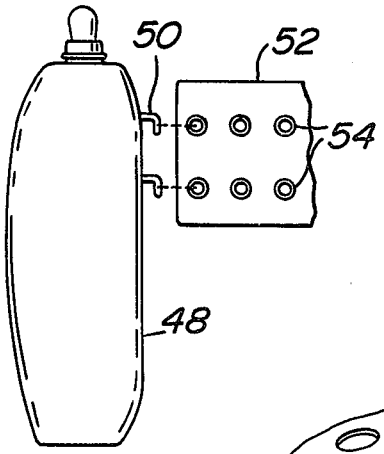
FIG. 4 is an elevation view of an alternate embodiment of the present invention.

An alternate embodiment of the present invention is illustrated in FIG. 4 wherein the non-spillable type drinking container of the present invention may be adapted for use as a military canteen or the like. The non-spillable drinking container 48 is provided with hooks 50 which are adapted to mount through parallel holes 54 of a military-type belt 52. In such application, a plurality of such containers may be hooked onto belt 52, and the containers may be discarded once their contents are consumed.

In use, the non-spillable drinking container 10 as shown in FIGS. 1 and 2 may be utilized in various applications where it is undesirable to have spillage and such spillage is likely to occur without some special precautions. In a preferred manner of use, the refrigerant container 30, which may take other forms, is filled with a refrigerant which may be frozen in advance. In a movie theater application, the container 12 may be prefilled through opening 27, after removal of cap 28, or it may be filled as wax paper drinking cups are now utilized, i.e., filled to the order of the consumer at the time of purchase from a soda-pop dispenser. In either case, the cap 28 would be reapplied after filling. When the consumer desired to drink from the container, removable cover or sanitary cover 24 would be removed or torn open. The consumer, when he desired to drink from the container would lift upward in the direction of arrow 46 on tube 20 either with his or her fingers or lips. The consumer could then draw fluid from container 12 by suction or by the application of pressure on sidewall 16. Immediately upon release of tube 20, expandable diaphragm 26 would cause tube 20 to be drawn against substantially flat surface 18 and with the closure of perforations 40, it would not be possible for further fluid to flow from container 12 through tube 20.

Figure 7:
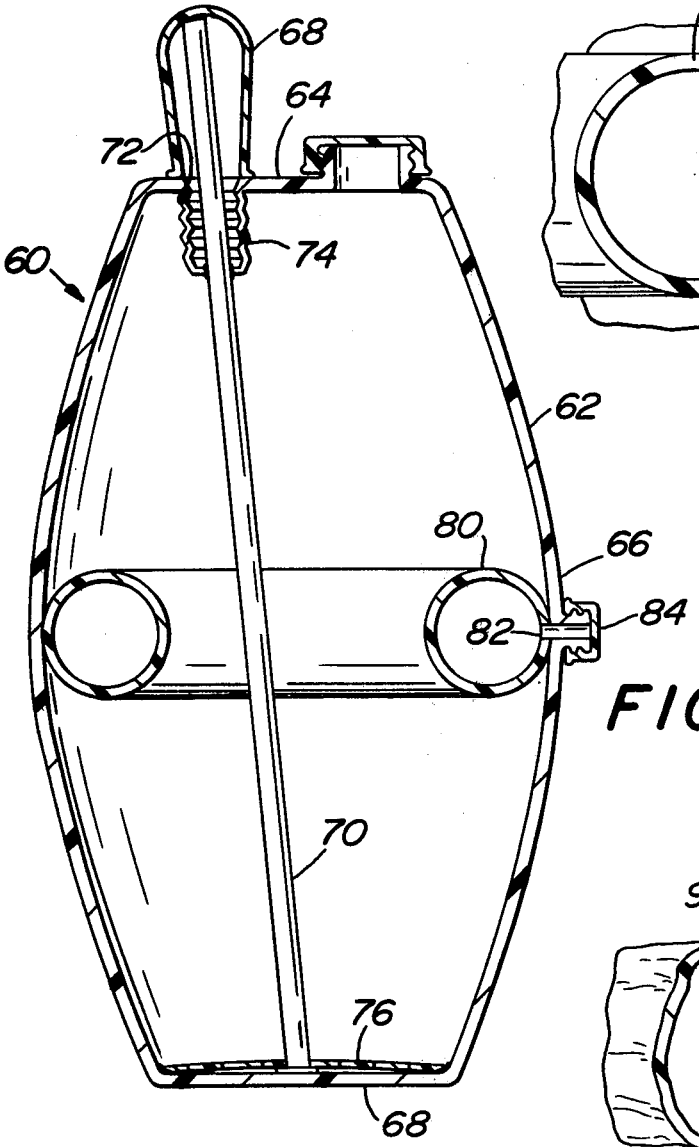
FIG. 7 is a cross-sectional view of an alternate embodiment of a non-spillable liquid drinking container in accordance with the present invention, particularly illustrating an external means for filling the refrigerant capsule and a means for retaining the drinking tube in a positive manner.

Referring now to FIG. 7, there is shown another embodiment of a non-spillable liquid drinking container 60. The non-spillable liquid drinking container 60 may be comprised, in a manner similar to the container as described with respect to FIG. 2, of a container 62 which may be comprised of a top portion 64, a sidewall portion 66 and a bottom or substantially flat surface 68. The container 62 is provided with an opening 72 for tube or straw 70. The tube 70 is mounted through opening 72 in container 62 and is provided with a sealing means 74 for providing a seal between the outer surface of the tube 70 and the opening 72 through container 62. Sealing means 74 is of the type which allows movement of the tube in a direction toward and away from the substantially flat surface or bottom 68 of container 62. Similarly as described with respect to FIG. 2, the sealing means 74 may be comprised of a bellows-type structure constructed of a suitably thin flexible synthetic plastic material.

An expandable diaphragm 76 is connected to the lower end of tube 70 and to container 62, preferably at the periphery of the bottom portion 68. The expandable diaphragm is provided with perforations (not shown) which may be the same or similar to those described with respect to FIGS. 1, 2, 5 and 6. The perforations may be slits which may preferably be formed so that the longitudinal direction of the slit in its unexpanded condition is perpendicular to imaginary radial lines of the diaphragm. When tube or straw 70 is pulled away from bottom 68, the expandable diaphragm 76 is expanded causing the perforations in the diaphragm to open as described previously with respect to FIGS. 1, 2, 5 and 6.

As shown in FIG. 7, sanitary cover 68 is selected of predetermined dimensions so that tube 70 is maintained in a positive manner tightly against bottom 68 of container 62 thereby insuring that the lower end of tube 70 is held in contact with bottom portion 68 and that expandable diaphragm 76 is not expanded. In this manner, sanitary cover 68 provides an additional positive means for insuring the non-spillage from container 62 especially under conditions where the container may be prefilled and the container may be shipped in the filled condition. Sanitary cover 68 may be a moisture impervious material, such as a synthetic plastic which insures long term non-spillage during periods of shipment and storage of pre-filled containers.

Figure 8:
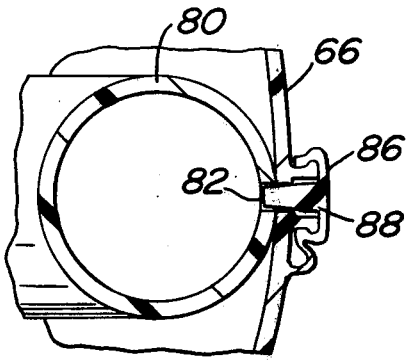
FIG. 8 is a broken away cross-sectional view illustrating an alternate refrigerant capsule filling means.
Figure 9:
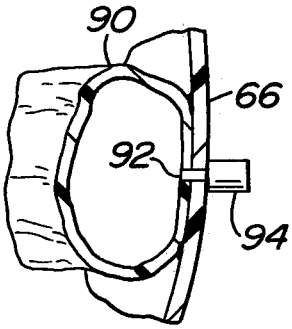
FIG. 9 is a broken away cross-sectional view illustrating an alternate embodiment of a refrigerant capsule.

Container 62 is provided with a refrigerant container or capsule 80 which may be provided in the shape of a circle of rotation, or otherwise described as a ring which taken in cross-section is in the form of a circle. Refrigerant capsule 80 is provided with an opening 82 into refrigerant capsule 80 which extends through sidewall 66 of container 62. As shown in FIG. 7, opening 82 may be sealed by a screw cap 84. Alternatively, as shown in the broken away view in FIG. 8, opening 82 may be provided with a seal in the form of a snap cap 86 which is provided with a sealing insert plug 88. Alternatively, another embodiment of a refrigerant capsule is shown in FIG. 9 wherein a collapsible refrigerant container or capsule 90 is provided with an opening 92 into the container and through sidewall 66. The opening 92 is sealed by a one way valve 94. The collapsible refrigerant container is preferably comprised of an elastic material which may be inflated by a refrigerant fluid under pressure through one way valve 94. One way valve 94 automatically allows the insertion of a refrigerant fluid under pressure into capsule 92 and prevents its exit. The one way valve 94 may be provided with a manually operable release to allow emptying of capsule 90. One way valves are commercially available and well known, and are not described here in detail.

Figure 10:
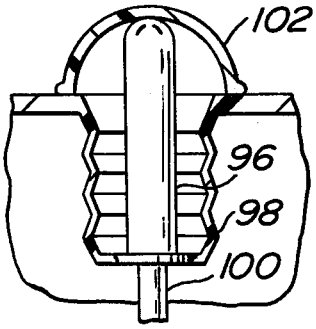
FIG. 10 is a broken away cross-sectional view illustrating an alternate embodiment utilizing a nipple structure.

Referring now to FIG. 10, another embodiment of the present invention is illustrated in which a non-spillable drinking container may be provided with a nipple structure, preferably for use by the very young, such as toddlers, which are accustomed to drinking from a nipple. There is shown in FIG. 10 a nipple structure 96 which is mounted to the upper end of tube 100 which extends down to the perforated expandable diaphragm. In a preferred embodiment, as illustrated in FIG. 10, the nipple 96 may be mounted to the bottom of the bellows type sealing means 98. However, it is understood that other variations and modifications in the location and means of mounting the nipple are within the scope of the present invention. For example, the tube could extend up through the bellows type sealing means and out of the container with a nipple mounted at the end of tube 100 at a position completely outside of the container. However, the structure as illustrated is presently preferred. The nipple 96 may also be provided with a sanitary cover 102 similar to those previously described.

It will be apparent to those skilled in the art that other modifications and changes may be made to the structure disclosed herein within the concepts of the present invention. For example, other types of sealing means may be utilized in place of the bellows type sealing means as illustrated in the presently preferred embodiment. For example, any suitable type of sealing means may be utilized so long as it provides a sealing function and allows movement of tube 20 in both directions along the longitudinal axis of tube 20, that is in the direction of arrows 44 and 46. Furthermore, other types of refrigerant containers or capsules may be utilized. The expandable diaphragm 26 may be mounted in other arrangements so long as it provides the function of retracting tube 20 against substantially flat surface 18 and provides for an opening of perforations upon the application of tension to tube 20 in the direction of arrow 46 and the closing of such perforations when such tension is removed from tube 20. In other words, the substantially flat surface need not form the bottom of the container. Furthermore, the form of the perforations in expandable diaphragm 26 may be changed, so long as a sealing function is provided by relaxation of expandable diaphragm 26 and an opening function is provided by the stretching or expanding of the expandable diaphragm 26. Other variations may also be provided in the form of sanitary shield 24.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. A non-spillable liquid drinking container, comprising:

a container having a substantially flat surface and provided with at least one opening therethrough substantially opposite said flat surface;

a tube mounted at least partially within said container and including means for engagement by the lips of a consumer extending outside of said container for a predetermined distance through said opening in said container;

sealing means for providing a seal between the outer surface of said tube and the opening through said container and allowing movement of said tube in a direction toward or away from said substantially flat surface of said container; and an expandable diaphragm mounted to the tube in proximity to the end of the tube juxtaposed a substantially flat surface of said container, the periphery of said diaphragm being mounted to said container, said diaphragm being provided with perforations therethrough which are normally closed in the unexpanded state of said expandable diaphragm and which are open when said expandable diaphragm is stretched by movement of said tube away from said substantially flat surface of said container.

2. A non-spillable liquid drinking container in accordance with claim 1 wherein said means for engagement by the lips of a consumer includes an extension of said tube which extends outside of said container for a predetermined distance.

3. A non-spillable liquid drinking container in accordance with claim 1 wherein said means for engagement by the lips of a consumer includes a nipple extending outside of said container for a predetermined distance.

4. A non-spillable liquid drinking container in accordance with claim 1 wherein said container is provided with a second opening therethrough, said opening being provided with a sealing means.

5. A non-spillable liquid drinking container in accordance with claim 4 wherein said sealing means for said second opening is a screw cap.

6. A non-spillable liquid drinking container in accordance with claim 5 wherein said sealing means for said second opening is a snap-on cap.

7. A non-spillable liquid drinking container in accordance with claim 1 wherein a removable cover is provided over the means for engagement by the lips of a consumer extending outside of said container through said opening in said container.

8. A non-spillable liquid drinking container in accordance with claim 1 wherein a cover is provided over the means for engagement by the lips of a consumer extending outside of said container through said opening in said container, and said cover is readily tearable to allow access to said tube by a consumer.

9. A non-spillable liquid drinking container in accordance with claim 1 wherein said sealing means providing a seal between the outer surface of said tube and the opening through said container includes a flexible sealing means.

10. A non-spillable liquid drinking container in accordance with claim 9 wherein said flexible sealing means includes a bellows-type structure.

11. A non-spillable liquid drinking container in accordance with claim 1 wherein said perforations in said flexible diaphragm are in the form of slits.

12. A non-spillable liquid drinking container in accordance with claim 11 wherein said slits have their longitudinal direction perpendicular to radii of said flexible diaphragm.

13. A non-spillable liquid drinking container in accordance with claim 1 including a container mounted within said container and being fillable with a freezeable fluid to provide a refrigerant within said container.

14. A non-spillable liquid drinking container in accordance with claim 13 including an opening into said refrigerant container through said non-spillable liquid drinking container.

15. A non-spillable liquid drinking container in accordance with claim 14 wherein said opening is provided with a screw cap.

16. A non-spillable liquid drinking container in accordance with claim 14 wherein said opening is provided with a snap closure cap.

17. A non-spillable liquid drinking container in accordance with claim 13 wherein said sealed refrigerant container is comprised of elastic collapsible walls and an opening into said sealed refrigerant container is provided with a one-way valve.

18. A non-spillable liquid drinking container in accordance with claim 1 wherein said container is provided with a pair of hooks for mounting to a belt of the like.

19. A non-spillable liquid drinking container, comprising:

a container having a bottom, sidewall and top portion, at least said sidewall being comprised of a resiliently flexible material, said top being provided with at least one opening therethrough;

a tube mounted partially within said container and extending outside of said container for a predetermined distance through said opening in said top of said container;

sealing means for providing a seal between the outer surface of said tube and the opening through said top portion of said container and allowing movement of said tube in a direction toward or away from said bottom of said container; and an expandable diaphragm mounted to the tube in proximity to the end of the tube juxtaposed the bottom of said container, the periphery of said expandable diaphragm being mounted to the inner surface of said container, said expandable diaphragm being provided with perforations therethrough which are normally closed in the unexpanded state of said expandable diaphragm and which are open when said expandable diaphragm is stretched by movement of said tube away from said bottom of said container.

20. A non-spillable liquid drinking container in accordance with claim 19 wherein said top of said container is provided with a second opening therethrough, said opening being provided with a sealing means.

21. A non-spillable liquid drinking container in accordance with claim 20 wherein said sealing means for said second opening is a screw cap.

22. A non-spillable liquid drinking container in accordance with claim 20 wherein said sealing means for said second opening is a snap-on cap.

23. A non-spillable liquid drinking container in accordance with claim 19 wherein a removeable cover is provided over the portion of said tube extending outside of said container through said opening in said top of said container 24. A non-spillable liquid drinking container in accordance with claim 19 wherein a cover is provided over the portion of said tube extending outside of said container through said opening and said top of said container, said cover being readily tearable by the consumer to provide access to said tube.

25. A non-spillable liquid drinking container in accordance with claim 19 wherein said sealing means providing a seal between the outer surface of said tube and the opening through said top of said container includes a flexible sealing means.

26. A non-spillable liquid drinking container in accordance with claim 25 wherein said flexible sealing means includes a bellows-type structure.

27. A non-spillable liquid drinking container in accordance with claim 19 wherein said perforations in said flexible diaphragm are in the form of slits.

28. A non-spillable liquid drinking container in accordance with claim 27 wherein said slits have a longitudinal direction perpendicular to radii of said flexible diaphragm.

29. A non-spillable liquid drinking container in accordance with claim 19 including a sealed container mounted within said container and being fillable with a freezeable fluid to provide a refrigerant within said container.

30. A non-spillable liquid drinking container in accordance with claim 29 including an opening into said refrigerant container through said non-spillable liquid drinking container.

31. A non-spillable liquid drinking container in accordance with claim 30 wherein said opening is provided with a screw cap.

32. A non-spillable liquid drinking container in accordance with claim 30 wherein said opening is provided with a snap closure cap.

33. A non-spillable liquid drinking container in accordance with claim 19 wherein said container is provided with a pair of hooks for mounting to a belt or the like.

* * * * *